US011873706B2

(12) United States Patent
Chen et al.

(10) Patent No.: US 11,873,706 B2
(45) Date of Patent: Jan. 16, 2024

(54) FLUID SEPARATING DEVICE

(71) Applicant: CHENGDU BISON TECHNOLOGY CO., LTD., Sichuan (CN)

(72) Inventors: Junhong Chen, Sichuan (CN); Shufei Liu, Sichuan (CN); Shice Su, Sichuan (CN); Hansen Liu, Sichuan (CN); Xiangmeike Liu, Sichuan (CN)

(73) Assignee: CHENGDU BISON TECHNOLOGY CO., LTD., Chengdu (CN)

( * ) Notice: Subject to any disclaimer, the term of this patent is extended or adjusted under 35 U.S.C. 154(b) by 986 days.

(21) Appl. No.: 16/643,533

(22) PCT Filed: Sep. 5, 2018

(86) PCT No.: PCT/CN2018/104241
§ 371 (c)(1),
(2) Date: Feb. 29, 2020

(87) PCT Pub. No.: WO2019/047872
PCT Pub. Date: Mar. 14, 2019

(65) Prior Publication Data

US 2020/0190956 A1 Jun. 18, 2020

(30) Foreign Application Priority Data

Sep. 6, 2017 (CN) ..... 201710794280.1

(51) Int. Cl.
*E21B 43/38* (2006.01)

(52) U.S. Cl.
CPC ..... *E21B 43/38* (2013.01)

(58) Field of Classification Search
CPC ..... E21B 43/38
See application file for complete search history.

(56) References Cited

U.S. PATENT DOCUMENTS 4,531,891 A * 7/1985 Coles, III ..... F04B 47/02 417/59
2008/0185141 A1 8/2008 Amies et al.
2017/0183946 A1* 6/2017 Tolman ..... E21B 47/09

FOREIGN PATENT DOCUMENTS

CN 104389782 A 3/2015
CN 104405319 A 3/2015
(Continued)

*Primary Examiner* — William D Hutton, Jr.
*Assistant Examiner* — Avi T Skaist
(74) *Attorney, Agent, or Firm* — Chieh-Mei Wang

(57) ABSTRACT

A fluid separating device includes a cylinder; a plurality of separators disposed around the cylinder; a first elastic piece disposed between one of the separators and the cylinder and applying an elastic force to the separator outward in a radial direction of the cylinder; a mandrel passing through the cylinder axially and configured to reciprocate between an expanded position and a contracted position in an axial direction of the cylinder; an elastic energy storage device slidably passing through the cylinder along the radial direction of the cylinder, the elastic energy storage device having one end connected to the mandrel and another end connected to the separator, the elastic energy storage device being configured to apply another elastic force to the mandrel in a direction from the contracted position to the expanded position; a first locking structure disposed on the cylinder; and a second locking structure disposed on the mandrel.

13 Claims, 16 Drawing Sheets

(56) References Cited

FOREIGN PATENT DOCUMENTS

| | | | |
|---|---|---|---|
| CN | 206111150 | U | 4/2017 |
| CN | 106640031 | A | 5/2017 |
| CN | 107313738 | A | 11/2017 |

* cited by examiner

FLUID SEPARATING DEVICE

CROSS-REFERENCE TO RELATED APPLICATION

This application is a national stage application of international application No. PCT/CN2018/104241, filed on Sep. 5, 2018, which claims priority to Chinese patent application No. 2017107942801, filed on Sep. 6, 2017, titled "Fluid separating device, wellhole structure and method for producing oil or natural gas," the disclosure of which are hereby incorporated by reference in their entirety.

FIELD OF THE INVENTION

The present invention relates to oil and natural gas exploitation, and more particularly to a fluid separating device.

BACKGROUND OF THE INVENTION

In the process of developing oil or natural gas well, when the production of oil or natural gas in the well is low and the pressure in the well is insufficient, a large amount of fluid cannot be lifted to the surface, and this forms a certain height of liquid at the bottom of the well, which further reduces the productivity of the oil or natural gas well, and even causes the oil or natural gas well to stop production.

A fluid separating device is provided in a related technology known by the inventor. A plurality of separators are provided on the outer peripheral surface of the fluid separating device, and these separators are always in contact with the inner wall of a wellhole under the action of the elastic pieces to form a seal. In this way the pressure generated by the oil or natural gas below the separating device drives the fluid separating device upward, and discharges the fluid accumulated above the fluid separating device when the fluid separating device ascends to the wellhead. The problem of this fluid separating device is that, because the separators are always in contact with the inner wall of the wellhole under the action of the elastic pieces, the fluid separating device cannot descend to the bottom of the well or descends slowly under the combined action of the friction between the separators and the inner wall of the wellhole and the pressure of the oil or natural gas below the fluid separating device.

SUMMARY OF THE INVENTION

An objective of the present disclosure is to overcome the shortcomings of the known technology, provide a fluid separating device, which can eliminate the friction between the separators and the inner wall of the wellhole when descending, and then can quickly descend to the bottom of the well.

The embodiments of the present invention are implemented by the following technology solutions:

The fluid separating device includes: a cylinder, a plurality of separators disposed around the cylinder, a first elastic piece, disposed between the separators and the cylinder, and applying a first elastic force to the separator outward along the radial direction of the cylinder; a mandrel, which is set through the cylinder axially and is configured to reciprocate between an expanded position and a contracted position along the axial direction of the cylinder; an elastic energy storage device that can slidably penetrate the cylinder along the radial direction of the cylinder, and has one end connected to the mandrel and the other end connected to the separator, the elastic energy storage device is configured to apply a third elastic force to the mandrel in the direction from the contracted position to the expanded position; a first locking structure disposed on the cylinder and a second locking structure disposed on the mandrel; in which, when the mandrel moves toward the contracted position, the elastic energy storage device is compressed and drives the separator to move inward along the radial direction of the cylinder; when the mandrel is in the contracted position, the first locking structure and the second locking structure are detachably fitted to maintain the mandrel in the contracted position.

Further, the elastic energy storage device includes a guiding post and an energy storage spring; the guiding post can slidably penetrate the cylinder along the radial direction of the cylinder; one end of the guiding post is connected to the separator, the other end of the guiding post is connected to one end of the energy storage spring; the other end of the energy storage spring is connected to the mandrel.

Further, the energy storage spring is a curved spring, and the energy storage spring includes a first force receiving arm, a second force receiving arm and a bending section; one end of the first force receiving arm is connected to the mandrel; one end of the second force receiving arm is connected to the guiding post; the other end of the first force receiving arm and the other end of the second force receiving arm are connected by the bending section.

Further, the end of the first force receiving arm which is away from the bending section is connected to a rotation section; a rotation hole is disposed on the guiding post; the rotation section is rotationally fitted with the rotation hole.

Further, an accommodation hole is disposed on an outer peripheral surface of the mandrel; the end of the second force receiving arm which is away from the bending section is embedded in the accommodation hole.

Further, the fluid separating device further includes a fixing shaft fixed in the cylinder; the bending section is disposed around the fixing shaft.

Further, the fluid separating device further includes a fixing ring fixed on an inner peripheral surface of the cylinder; a fixing groove is disposed on the fixing ring; the fixing shaft is fixed in the fixing groove.

Further, the first locking structure includes a locking piece and a second elastic piece; the second locking structure is a locking groove disposed on the mandrel; the second elastic piece is located between the locking piece and the inner surface of the cylinder, and applies a second elastic force to the locking piece inward along the radial direction of the cylinder; when the mandrel is in the contracted position, the locking piece is embedded in the second locking structure under the action of the second elastic piece.

Further, the locking piece includes a base, a first locking arm and a second locking arm which are spaced out; the first locking arm and the second locking arm are both connected to the base; the first locking arm is used to be embedded in the second locking structure; the first locking arm is separated from the second locking structure; the fluid separating device further includes a start shaft; the start shaft is disposed slidably at one end of the cylinder which is near the contracted position; when the start shaft moves in the direction from the contracted position to the expanded position, the start shaft pushes the second locking arm to move radially outward, so that the first locking arm is separated from the second locking structure.

Further, the first locking structure further includes a support shaft fixed in the cylinder; the support shaft is located between the first locking arm and the second locking arm.

Further, an annular space is formed between a part of an inner peripheral surface of the cylinder and a part of an outer peripheral surface of the mandrel.

Further, an outlet and an inlet communicating the annular space with the outside environment are disposed on the cylinder; the separator is located between the outlet and the inlet; the outlet is near the expanded position; the inlet is near the contracted position; the fluid separating device further includes a blocking unit connected to the mandrel; when the mandrel is located in the expanded position, the blocking unit closes the outlet; when the blocking unit is located in the contracted position, the blocking unit is away from the outlet, so that the outlet is open.

Further, the blocking unit includes a connecting ring sleeved on the mandrel, a connecting section extending radially outward from the connecting ring, and a blocking piece connected to the end of the connecting section which is away from the connecting ring.

Further, a plurality of outlets are spaced out around the axis of the cylinder; a plurality of connecting sections are spaced out around the axis of the connecting ring; a plurality of connecting sections correspond to a plurality of outlets one by one; each of the connecting sections is respectively connected to one of the blocking pieces; a guiding piece is disposed between the adjacent blocking pieces in the cylinder, and slidably contacts the adjacent blocking pieces.

The technical solutions of the present invention have at least the following advantages and benefits:

In operation of the fluid separating device provided by the embodiment of the present invention, when the fluid separating device ascends to the upper end of the wellhole, the mandrel strikes the upper percussion device, so that the mandrel moves from the expanded position to the contracted position. When the mandrel is located in the contracted position, the separator is not in contact with the inner wall of the wellhole and forms an annular gap to allow fluid to pass through. In this way, the friction between the separators and the inner wall of the wellhole is eliminated, and the oil or natural gas below the fluid separating device can flow upward through the annular gap, reduces the downward resistance to the fluid separating device, so that the fluid separating device can quickly descend back to the bottom of the well. Even when the well is not shut down, the fluid separating device can quickly descend back to the bottom of the well. At the same time, during the downward movement of the fluid separating device, the service life of the separator is greatly improved due to the elimination of the friction between the separator and the inner wall of the wellhole. In addition, because the fluid separating device ascends under the thrust of the oil or natural gas below, its upward speed is fast, and the impact force between the mandrel and the upper percussion device is large, as the mandrel moves toward the contracted position, the elastic energy storage device and the first elastic piece are compressed, so that the kinetic energy generated by the impact is stored in the elastic energy storage device. The fluid separating device descends under the action of its own gravity, its downward speed is slower than the upward speed, and the impact force between the mandrel and the lower percussion device is small. Because energy is stored in the elastic energy storage device, it is only required that the first locking device and the second locking device can be separated from each other when the mandrel strikes the lower percussion device, the elastic energy storage device can drive the mandrel to move to the expanded position. In this way, the requirement for the impact force of the mandrel and the lower percussion device is reduced, and only a small impact force between the mandrel and the lower percussion device is needed to complete the transition of the mandrel from the contracted position to the expanded position, which improves the reliability of the fluid separating device at work.

BRIEF DESCRIPTION OF THE DRAWINGS

In order to illustrate the technical solutions of the embodiments of the present invention more clearly, the drawings that need to be used in the embodiments are briefly introduced below. It should be understood that the following drawings only show certain embodiments of the present invention and should not be construed as limiting the scope of the present invention. For the technicians in this field, they can obtain other drawings according to these drawings without any creative labor.

DETAILED DESCRIPTION OF PREFERRED EMBODIMENTS

Figure 1:
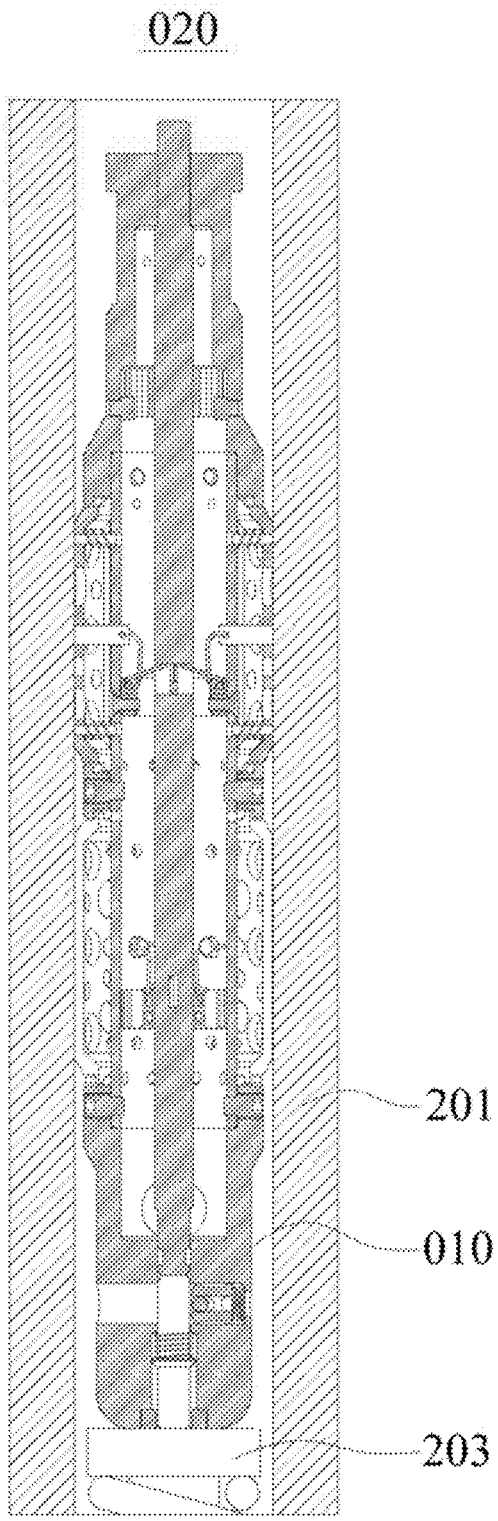
FIG. 1 is a cross-sectional view of a wellhole structure according to a first embodiment of the present disclosure.

In order to make the objectives, technical solutions and advantages of the embodiments in the present invention clearer, the technical solutions in the embodiments of the present invention will be clearly and completely described below with reference to the accompanying drawings. Obviously, the described embodiments are a part of embodiments of the present invention, but not all the embodiments.

Therefore, the following detailed description of the embodiments of the present invention is not intended to limit the protection scope of the claimed present invention, but only to show some of the embodiments of the present invention. Based on the embodiments of the present invention, all other embodiments obtained by the technicians in this field without any creative labor shall fall within protection scope of the claimed present invention.

It should be noted that, in the case of no conflict, the embodiments of the present invention, the characteristics and technical solutions of the embodiments can be combined with each other.

It should be noted that: similar reference numbers and letters indicate similar items in the following drawings, so there is no need to further define and explain it in subsequent drawings once an item is defined in one drawing.

In the description of the present invention, it should be noted that the orientations or positional relationships indicated by the terms "up" and "down" are based on the orientations or positional relationships shown in the drawings, or are commonly used when the products of the present invention are used, or are commonly understood by the technicians in this field, such terms are only for the convenience of describing the present invention and simplifying the description, rather than indicating or implying that the device or component referred to must have a specific orientation, or be configured and operate in a specific orientation, so that they cannot be understood as limitations to the present invention.

The terms "first", "second", etc, are only used to distinguish descriptions, and cannot be understood to indicate or imply relative importance.

Embodiment 1

Figure 2:
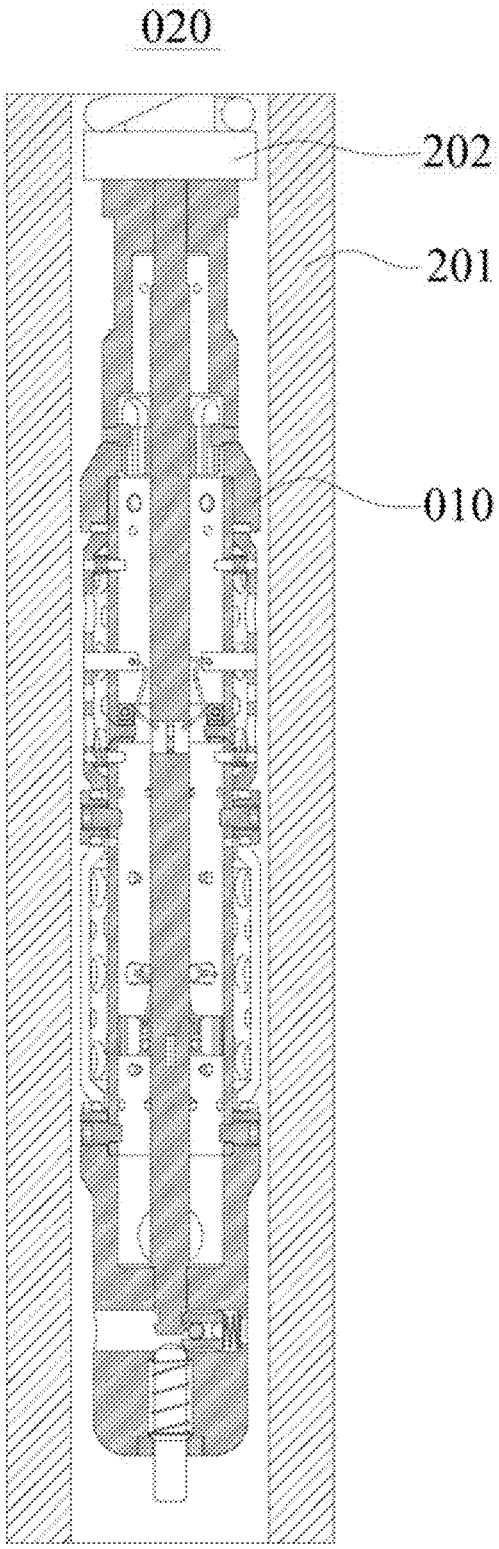
FIG. 2 is another cross-sectional view of the wellhole structure according to the first embodiment of the present disclosure.

Refer to FIG. 1 and FIG. 2, FIG. 1 is a cross-sectional view of a wellhole structure 020 according to this embodiment, FIG. 2 is another cross-sectional view of the wellhole structure 020 according to this embodiment. It can be seen from FIG. 1 and FIG. 2 in this embodiment that, the wellhole structure 020 includes a wellhole 201, an upper percussion device 202 (shown in FIG. 1) and a lower percussion device 203 (shown in FIG. 2) respectively disposed at the upper and lower ends of the wellhole 201 and a fluid separating device 010 disposed in the wellhole 201. The fluid separating device 010 slides in the up-and-down direction in the wellhole 201. When the fluid separating device 010 moves to the upper end of the wellhole 201, the fluid separating device 010 strikes the upper percussion device 202. When the fluid separating device 010 moves to the lower end of the wellhole 201, the fluid separating device 010 strikes the lower percussion device 203.

The fluid separating device 010 is further described below.

Figure 3:
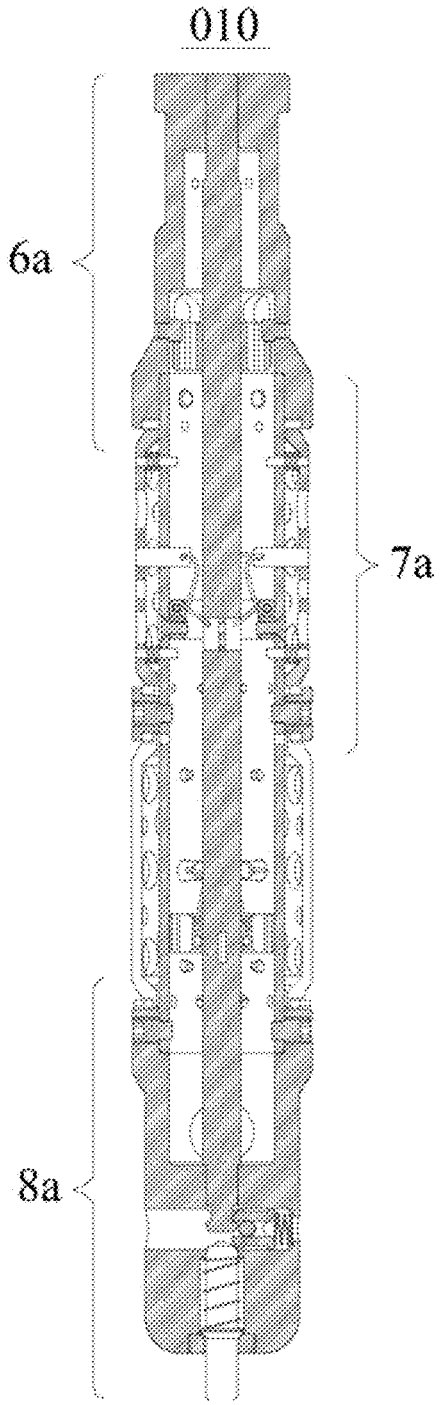
FIG. 3 is a cross-sectional view of a fluid separating device according to the first embodiment of the present disclosure, with a mandrel being located in a contracted position.
Figure 4:
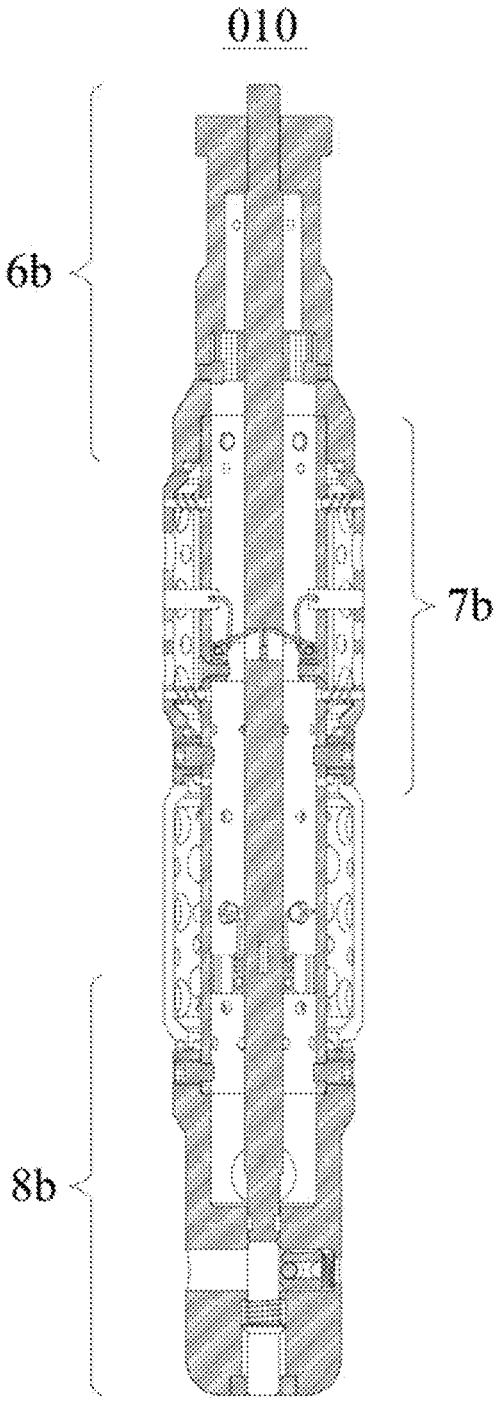
FIG. 4 is a cross-sectional view of the fluid separating device according to the first embodiment of the present disclosure, with the mandrel being located between the contracted position and an expanded position.
Figure 5:
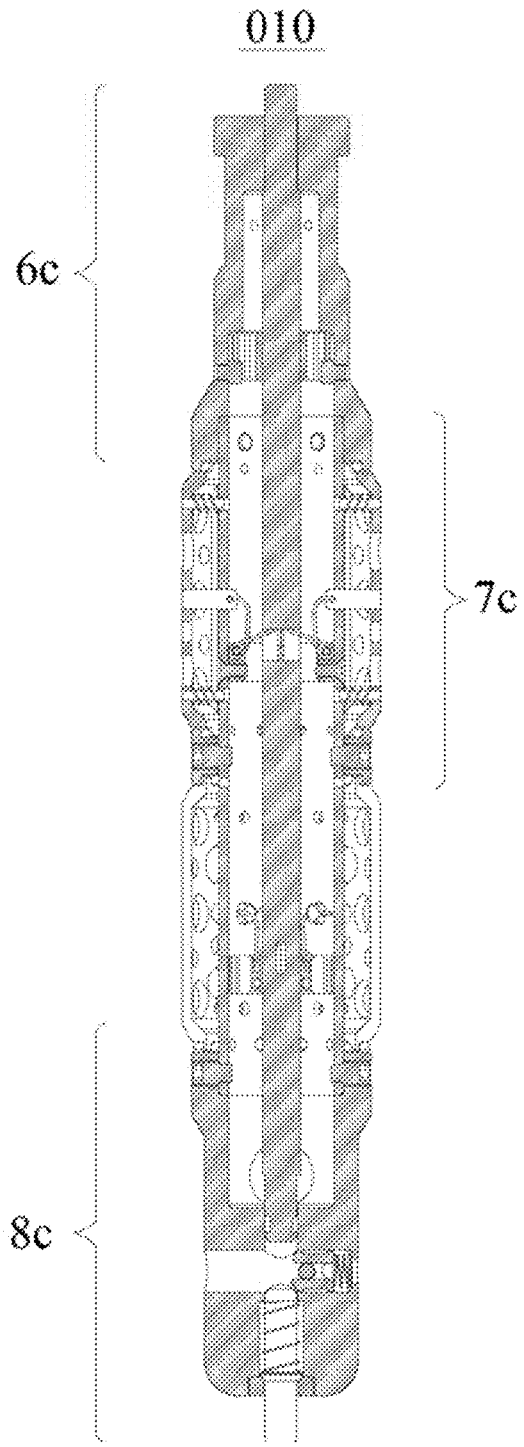
FIG. 5 is a cross-sectional view of the fluid separating device according to the first embodiment of the present disclosure, with the mandrel being located in the expanded position.
Figure 6A:
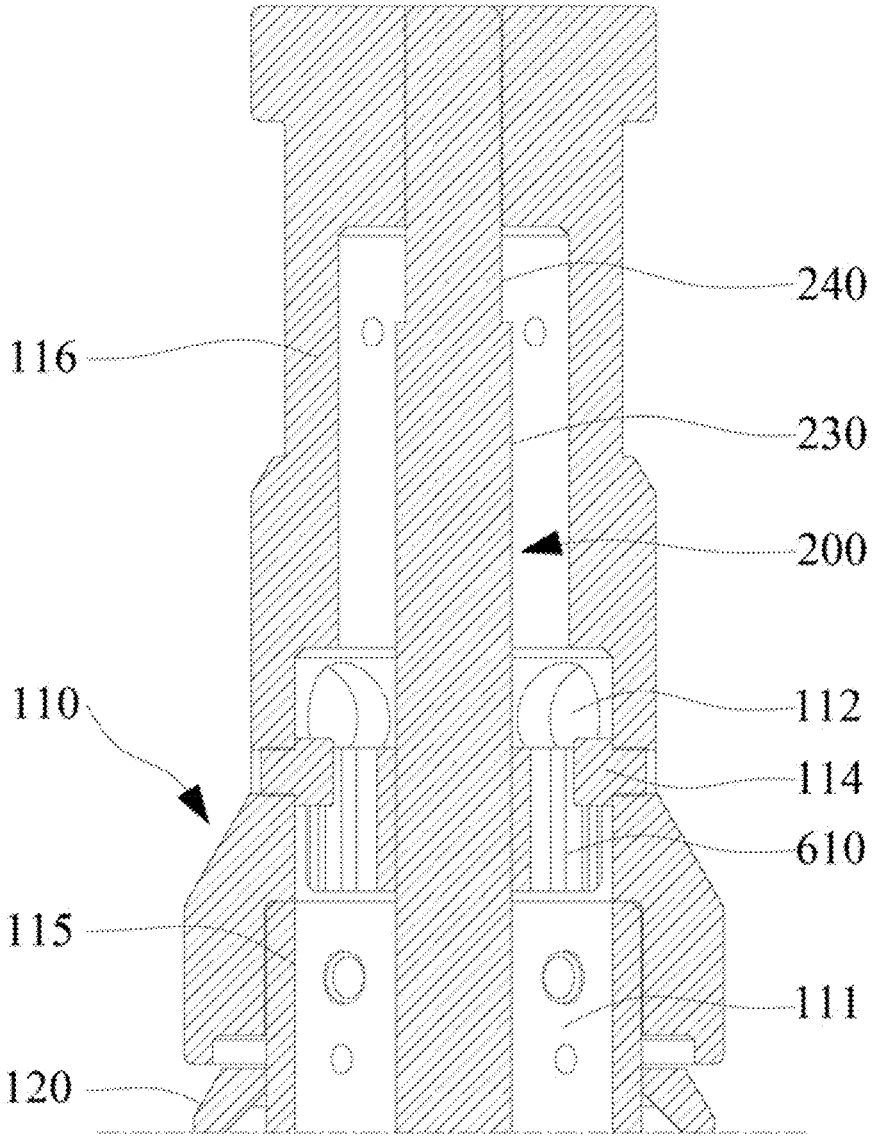
FIG. 6*a* is an enlarged view of brace 6*a* in FIG. 3.
Figure 6B:
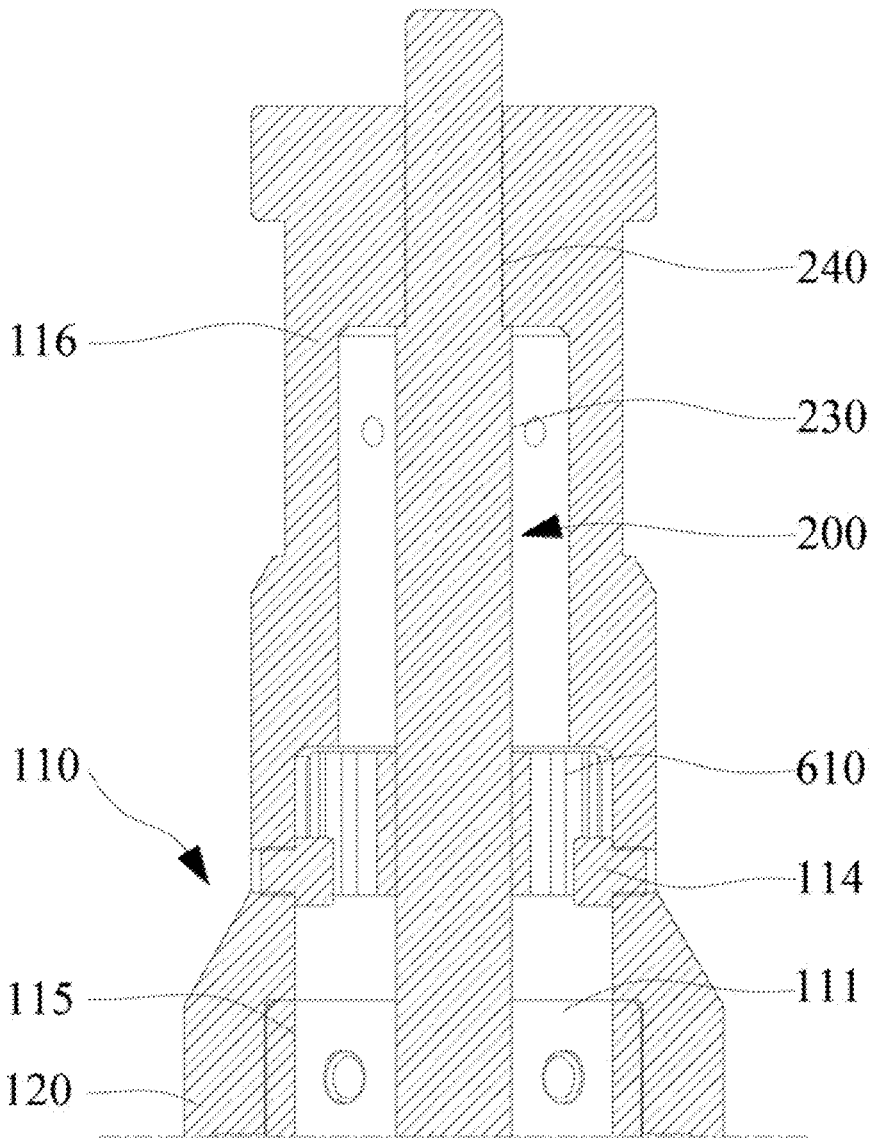
FIG. 6*b* is an enlarged view of brace 6*b* in FIG. 4.
Figure 6C:
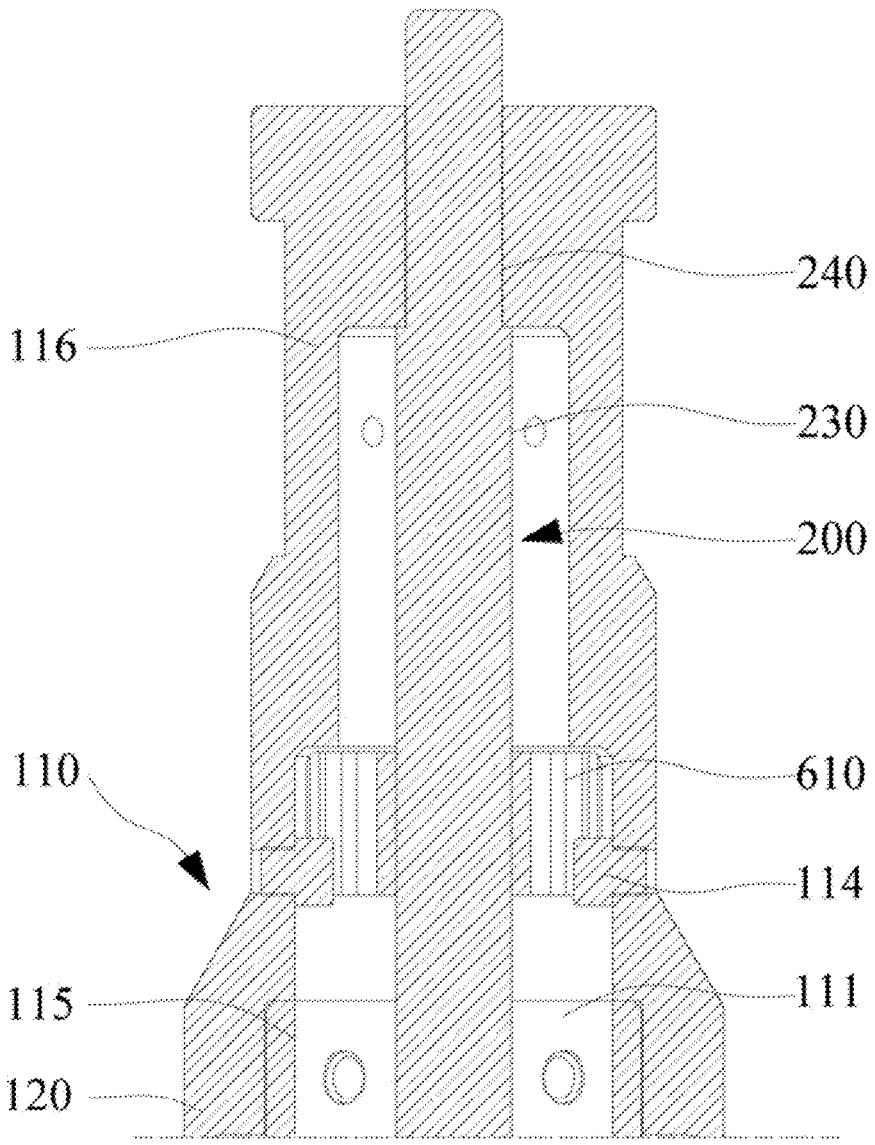
FIG. 6*c* is an enlarged view of brace 6*c* in FIG. 5.
Figure 7A:
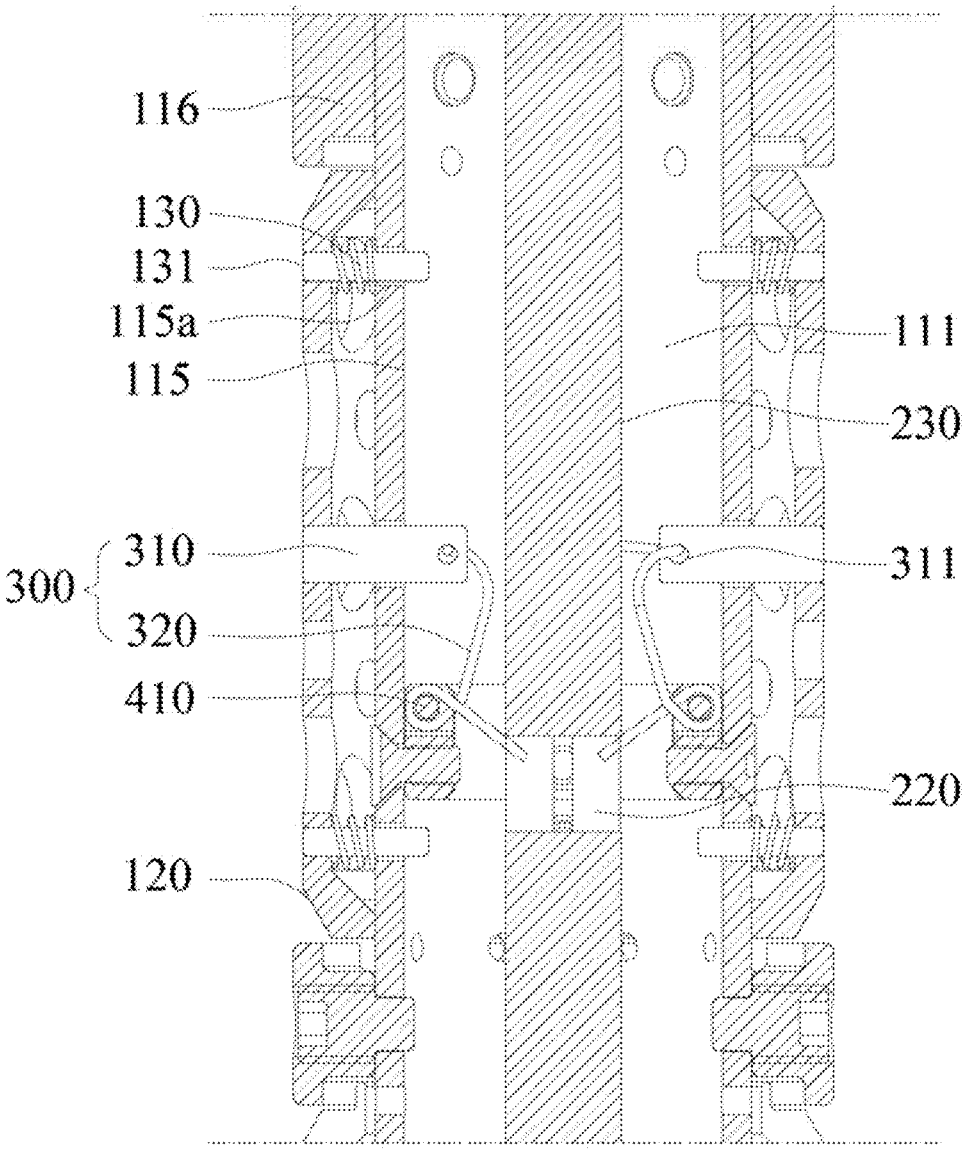
FIG. 7*a* is an enlarged view of brace 7*a* in FIG. 3.
Figure 7B:
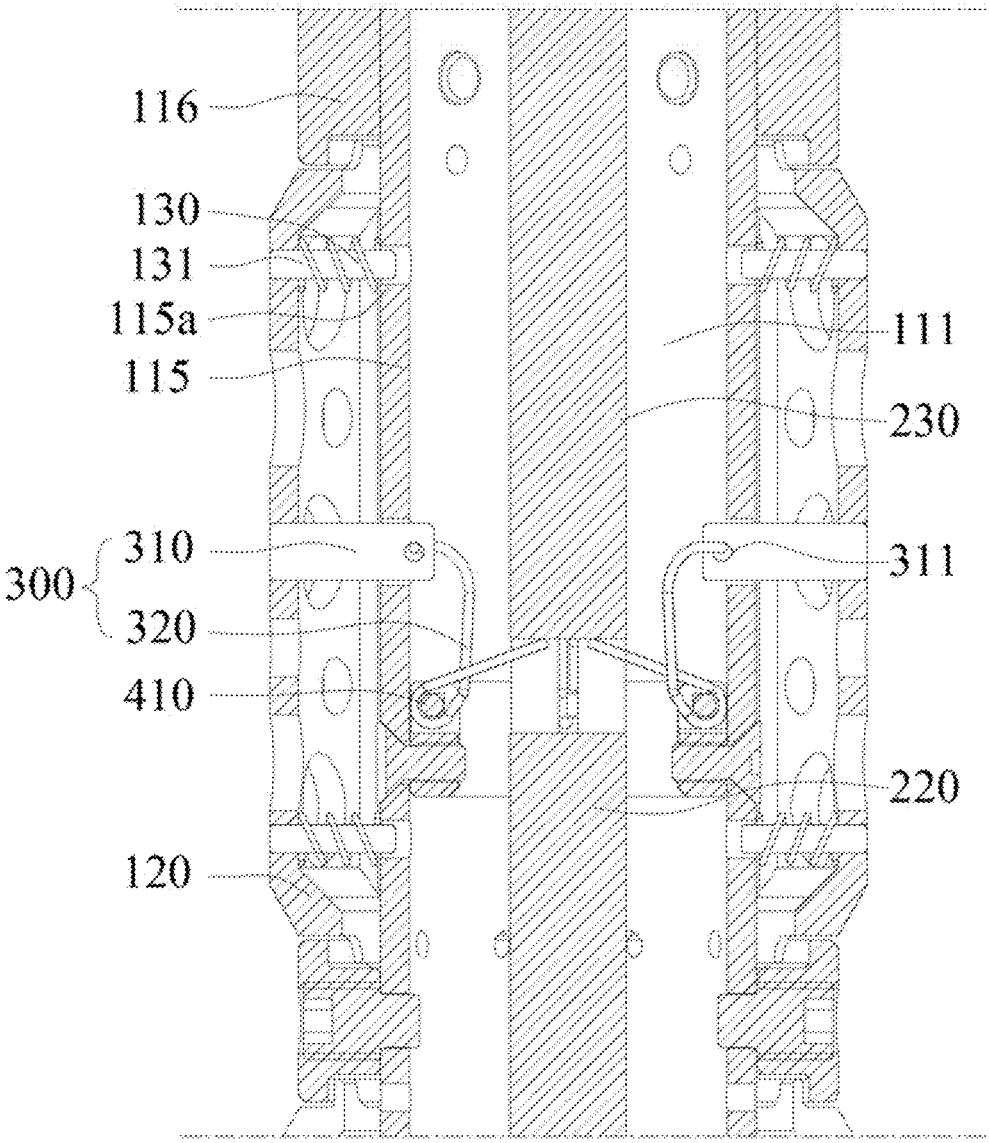
FIG. 7*b* is an enlarged view of brace 7*b* in FIG. 4.
Figure 7C:
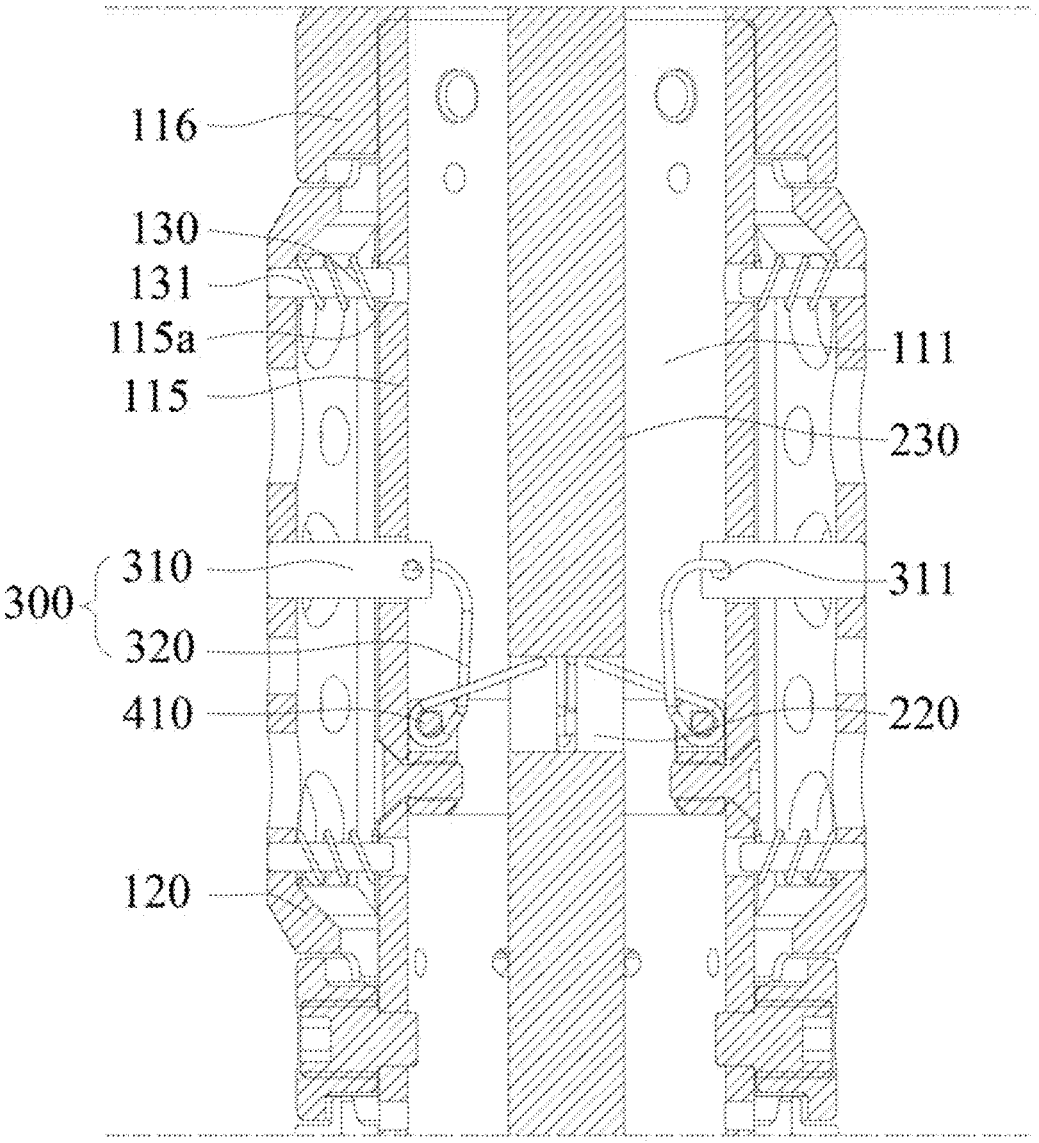
FIG. 7*c* is an enlarged view of brace 7*c* in FIG. 5.
Figure 8A:
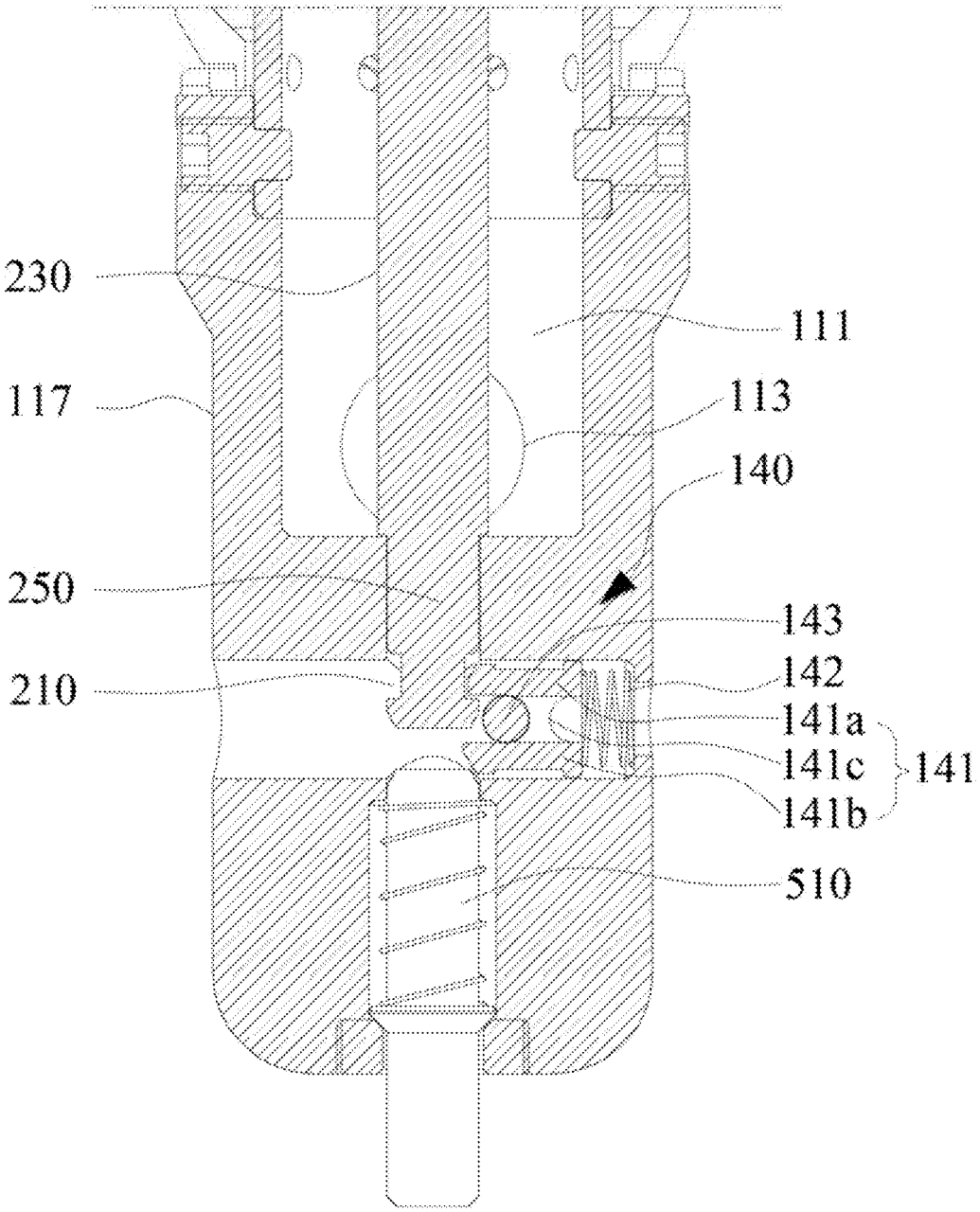
FIG. 8*a* is an enlarged view of brace 8*a* in FIG. 3.
Figure 8B:
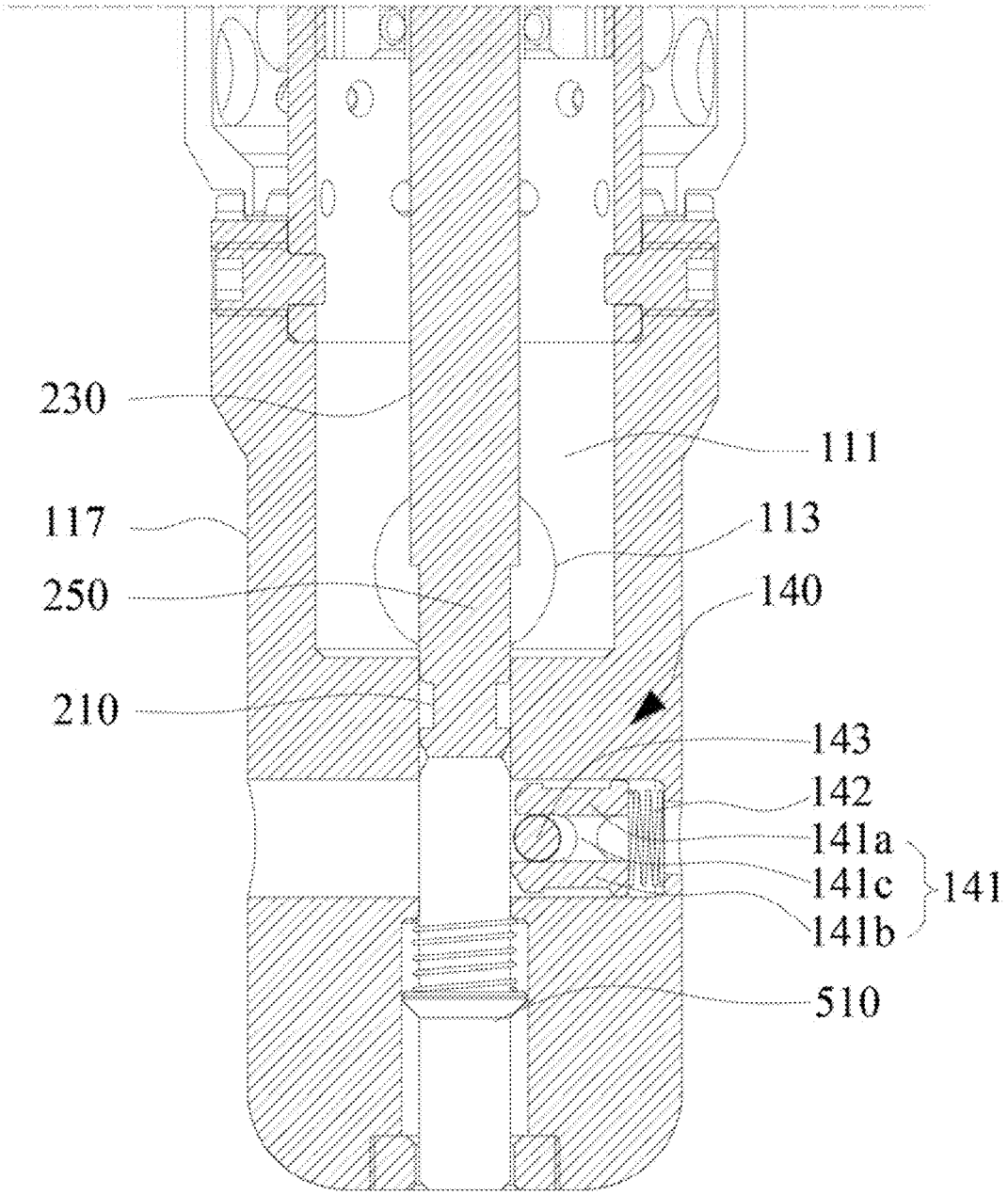
FIG. 8*b* is an enlarged view of brace 8*b* in FIG. 4.
Figure 8C:
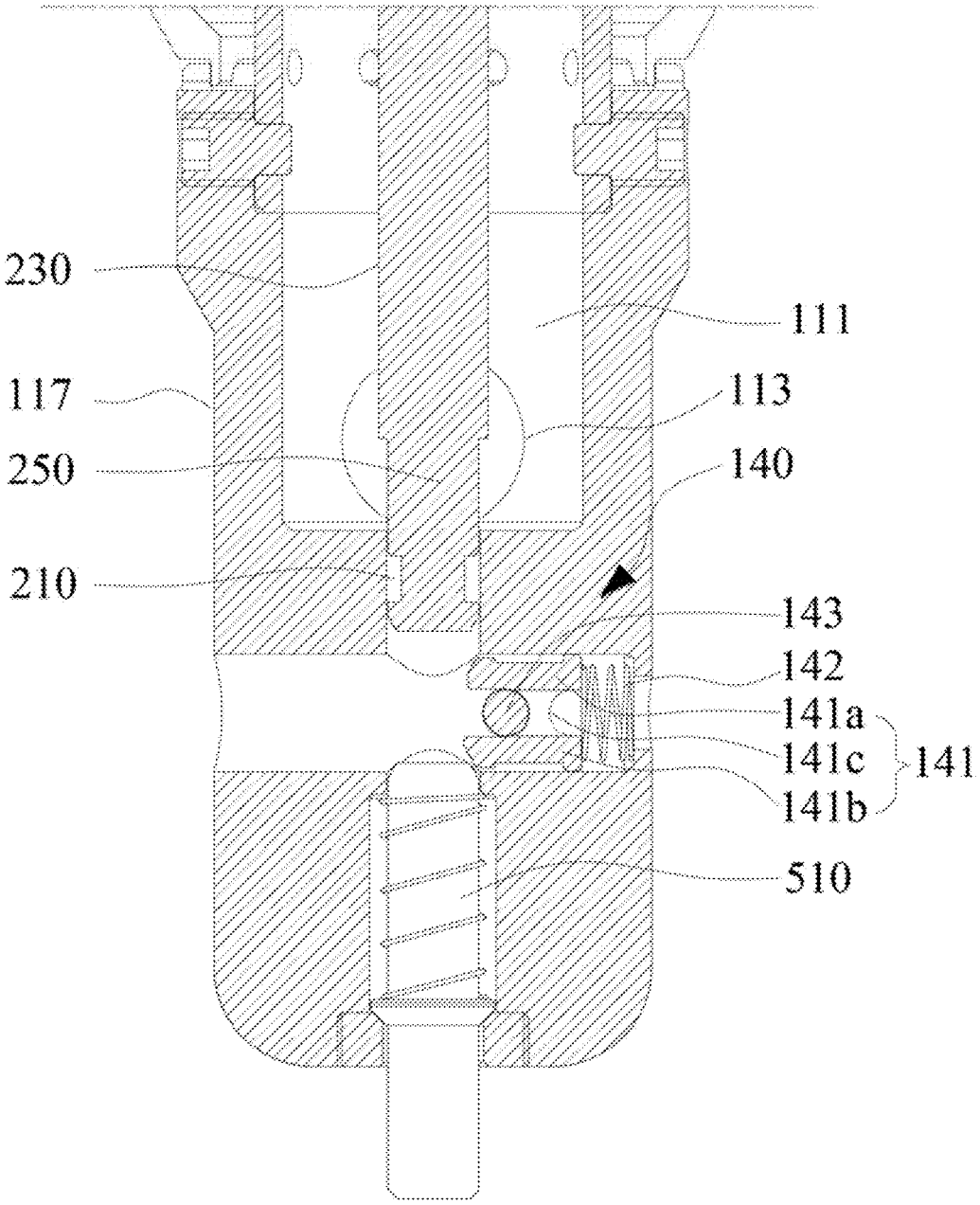
FIG. 8*c* is an enlarged view of brace 8*c* in FIG. 5.

FIG. 3, FIG. 4 and FIG. 5 show three working states of the fluid separating device 010 respectively. FIG. 6*a* is an enlarged view of brace 6*a* in FIG. 3, FIG. 6*b* is an enlarged view of brace 6*b* in FIG. 4, FIG. 6*c* is an enlarged view of brace 6*c* in FIG. 5. FIG. 7*a* is an enlarged view of brace 7*a* in FIG. 3, FIG. 7*b* is an enlarged view of brace 7*b* in FIG. 4, FIG. 7*c* is an enlarged view of brace 7*c* in FIG. 5. FIG. 8*a* is an enlarged view of brace 8*a* in FIG. 3, FIG. 8*b* is an enlarged view of brace 8*b* in FIG. 4, FIG. 8*c* is an enlarged view of brace 8*c* in FIG. 5.

With reference to the above drawings, in this embodiment, the fluid separating device 010 includes a cylinder 110, a separator 120, a first elastic piece 130, a first locking structure 140, a mandrel 200, a second locking structure 210 and an elastic energy storage device 300.

The cylinder 110 includes a straight cylinder 115, an upper end head 116 and a lower end head 117. The upper end head 116 is cylindrical and connected with a screw on the upper end of the straight cylinder 115. The lower end head 117 is cylindrical and connected with a screw on the lower end of the straight cylinder 115. The mandrel 200 includes a shaft body 230, an upper end shaft 240 and a lower end shaft 250 located at the two ends of the shaft body 230. The shaft body 230, the upper end shaft 240 and the lower end shaft 250 are coaxial, and the diameters of the upper end shaft 240 and the lower end shaft 250 are smaller than the diameter of the shaft body 230. The upper end shaft 240 slidably fits with the upper end head 116, the lower end shaft 250 slidably fits with the lower end head 117. In this way, the mandrel 200 can move along the axial direction of the cylinder 110. When the mandrel 200 moves to the uppermost position, the upper end surface of the shaft body 230 abuts against the inner surface of the upper end head 116, at this time, the position where the mandrel 200 is located is called an expanded position. When the mandrel 200 moves to the lowest position, the lower end surface of the shaft body 230 abuts against the inner surface of the lower end head 117, at this time, the position where the mandrel 200 is located is called a contracted position.

A plurality of separators 120 are disposed around the straight cylinder 115. The first elastic piece 130 is disposed between the separator 120 and the straight cylinder 115. The first elastic piece 130 applies a first elastic force radially outward to the separator 120 relative to the straight cylinder 115, so that the separator 120 moves radially outward relative to the straight cylinder 115, and then contacts the inner wall of the wellhole 201 to realize the seal between the fluid separating device 010 and the wellhole 201. In this embodiment, the first elastic piece 130 is a spring, one end is connected to the separator 120 and the other end is connected to an outer peripheral surface of the straight cylinder 115. In order to make the radial movement of the separator 120 more stable, in this embodiment, a post 131 is further provided. A through-hole 115*a* is disposed on the straight cylinder 115, and the axis of the through-hole 115*a* is perpendicular to the axis of the straight cylinder 115. One end of the post 131 is connected to the separator 120, the other end of the post 131 can slidably penetrate the through-hole 115*a*. In this way, by the sliding cooperation of the post 131 and the through-hole 115*a*, the movement of the separator 120 is guided, so that the radial movement of the separator 120 is more stable. In order to make the internal structure of the fluid separating device 010 more compact, in this embodiment, the first elastic piece 130 is sleeved on the post 131.

The elastic energy storage device 300 can slidably penetrate the straight cylinder 115 along the radial direction of the straight cylinder 115, and one end is connected to the mandrel 200 and the other end is connected to the separator 120. The elastic energy storage device 300 applies a third elastic force to the mandrel 200 in the direction from the contracted position to the expanded position. In this embodiment, the elastic energy storage device 300 includes a guiding post 310 and an energy storage spring 320; the guiding post 310 can slidably penetrate the cylinder 110 along the radial direction of the straight cylinder 115; one end of the guiding post 310 is connected to the separator 120, and the other end of the guiding post 310 is connected to one end of the energy storage spring 320; the other end of the energy storage spring 320 is connected to the mandrel 200. When the fluid separating device 010 ascends along the wellhole 201 and the upper end shaft 240 strikes the upper percussion device 202, the mandrel 200 moves from the expanded position to the contracted position. During this process, the energy storage spring 320 is compressed and stores elastic energy. At the same time, the energy storage spring 320 pulls the guiding post 310 to move radially inward relative to the straight cylinder 115, and the straight cylinder 115 further drives the separator 120 to overcome the first elastic force of the first elastic piece 130 and move radially inward relative to the straight cylinder 115. At this time, the separator 120 is separated from the inner wall of the wellhole 201 so that an annular gap is formed between the fluid separating device 010 and the separator 120. The first locking structure 140 is disposed on the cylinder 110, and the second locking structure 210 is disposed on the mandrel 200. When the mandrel 200 is located in the contracted position, the first locking structure 140 and the second locking structure 210 can be detachably fitted to maintain the mandrel 200 in the contracted position. In this way, the friction between the separator 120 and the inner wall of the wellhole 201 is eliminated, and the oil or natural gas below the fluid separating device 010 can flow upward through the annular gap, which reduces the downward resistance to the fluid separating device 010, so that the fluid separating device 010 can quickly descend back to the bottom of the well. Even when the well is not shut down, the fluid separating device 010 can also quickly descend back to the bottom of the well. At the same time, during the downward movement of the fluid separating device 010, since the friction between the separator 120 and the inner wall of the wellhole 201 is eliminated, the service life of the separator 120 is also greatly improved. When the fluid separating device 010 moves to the bottom of the well, the mandrel 200 strikes the lower percussion device 203. Under the action of the impact force, the first locking structure 140 and the second locking structure 210 are separated from each other. At this time, the energy storage spring 320 releases the elastic energy stored therein and drives the mandrel 200 to move from the contracted position to the expanded position. At the same time, the first elastic piece 130 drives the separator 120 to move radially outward, so that the separator 120 is in contact with the inner wall of the wellhole 201 to form a seal. In this way, it is difficult for the oil or natural gas below the fluid separating device 010 to flow above the fluid separating device 010, the pressure of the oil or natural gas below the fluid separating device 010 increases, and the generated thrust drives the fluid separating device 010 to ascend at a high speed, and then the liquid accumulated above the fluid separating device 010 is discharged.

The fluid separating device 010 ascends under the thrust of the oil or natural gas below, its upward speed is fast, the impact force of the mandrel 200 and the upper percussion device 202 is large, as the mandrel 200 moves toward the contracted position, the elastic energy storage device 300 and the first elastic piece 130 are compressed, so that the kinetic energy generated by the impact is stored in the elastic energy storage device 300. The fluid separating device 010 descends under the action of its own gravity, its downward speed is slower than the upward speed, and the impact force of the mandrel 200 and the lower percussion device 203 is small. Because energy is stored in the elastic energy storage device 300, it is only required that the first locking structure 140 and the second locking structure 210 can be separated from each other when the mandrel 200 strikes the lower percussion device 203, the elastic energy storage device 300 can drive the mandrel 200 to move to the expanded position. In this way, the requirement of the impact force of the mandrel 200 and the lower percussion device 203 is reduced, only a small impact force between the mandrel 200 and the lower percussion device 203 is needed to complete the transition of the mandrel 200 from the contracted position to the expanded position, which improves the reliability of the fluid separating device 010 at work.

Figure 9:
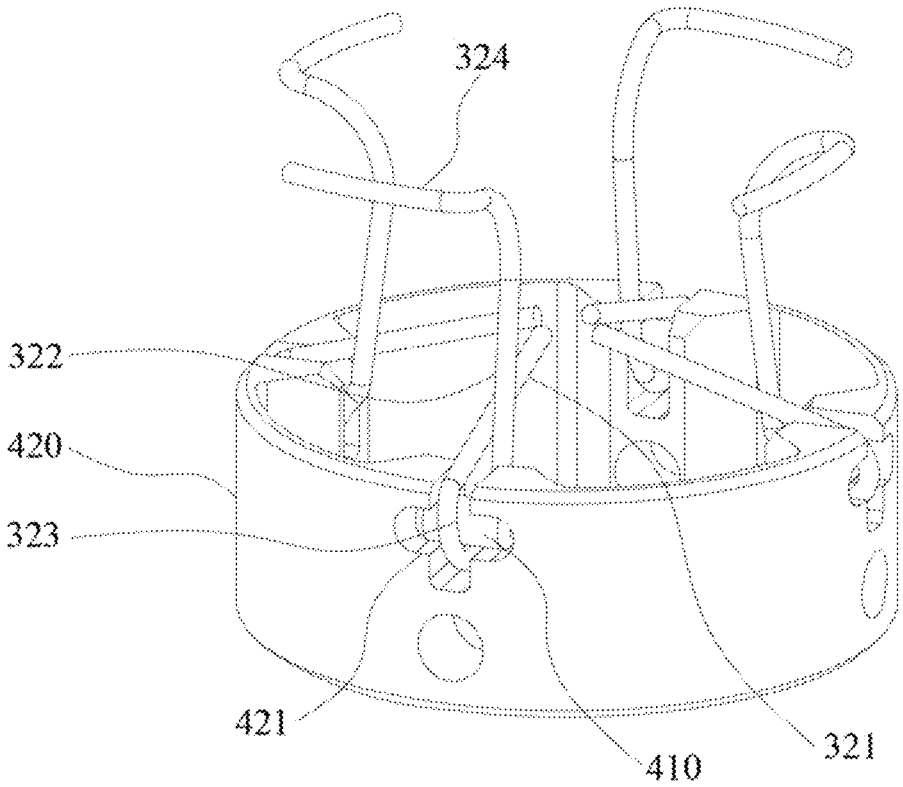
FIG. 9 is a cross-sectional view of the connecting structure between an energy storage spring and a fixing ring in the fluid separating device according to the first embodiment of the present disclosure.

Refer to FIG. 9, FIG. 9 shows the detailed structure of the energy storage spring 320. In this embodiment, the energy storage spring 320 is a curved spring; the energy storage spring 320 includes a first force receiving arm 321, a second force receiving arm 322 and a bending section 323; one end of the first force receiving arm 321 is connected to the mandrel 200; one end of the second force receiving arm 322 is connected to the guiding post 310; the other end of the first force receiving arm 321 is connected to the other end of the second force receiving arm 322 by the bending section 323; when the mandrel 200 moves toward the contracted position, the bending section 323 is deformed and stores elastic energy. Further, in this embodiment, a rotation section 324 is connected to the end of the first force receiving arm 321 which is away from the bending section 323; a rotation hole 311 is disposed on the guiding post 310; the rotation section 324 is rotationally fitted with the rotation hole 311. An accommodation hole 220 is disposed on an outer peripheral surface of the mandrel 200; the end of the second force receiving arm 322 which is away from the bending section 323 is embedded in the accommodation hole 220. In this way, the dynamic connection of the energy storage spring 320 with the guiding post 310 and the mandrel 200 can be realized, the stress concentration at the first force receiving arm 321 and the second force receiving arm 322 during the deformation of the energy storage spring 320 is avoided, and the working life of the energy storage spring 320 is effectively improved.

Further, in order to better position the energy storage spring 320, in this embodiment, the fluid separating device 010 further includes a fixing shaft 410 fixed in the cylinder 110; the bending section 323 is disposed around the fixing shaft 410. In this way, the energy storage spring 320 can be effectively positioned and the working stability of the energy storage spring 320 is improved. The fluid separating device 010 further includes a fixing ring 420 fixed on an inner peripheral surface of the cylinder 110; a fixing groove 421 is disposed on the fixing ring 420; the fixing shaft 410 is fixed in the fixing groove 421.

The following is a description of the first locking structure 140 and the second locking 210. In this embodiment, the first locking structure 140 includes a locking piece 141 and a second elastic piece 142; the second locking structure 210 is a locking groove disposed on the mandrel 200; the second elastic piece 142 is located between the locking piece 141 and the inner surface of the cylinder 110, and applies a second elastic force to the locking piece 141 inward along the radial direction of the cylinder 110; when the mandrel 200 moves to (or is in) the contracted position, the locking piece 141 is embedded in the second locking structure 210 under the action of the second elastic piece 142. When the mandrel 200 strikes the lower percussion device 203, the locking piece 141 overcomes the second elastic force of the second elastic piece 142 and moves outward along the radial direction of the cylinder 110, and then separates from the second locking structure 210. In this way, the limit effect on the mandrel 200 is released, and the mandrel 200 can move to the expanded position driven by the elastic energy storage device 300.

The impact between the lower end shaft 250 of the mandrel 200 and the lower percussion device 203 can be a direct impact or an indirect impact. In this embodiment, an indirect impact occurs between the lower end shaft 250 of the mandrel 200 and the lower percussion device 203. Specifically, the locking piece 141 includes a base 141*c*, and a first locking arm 141*a* and a second locking arm 141*b* which are spaced out; the first locking arm 141*a* and the second locking arm 141*b* are both connected to the base 141*c*; the first locking arm 141*a* is used to be embedded in the second locking structure 210. The fluid separating device 010 further includes a start shaft 510; the start shaft 510 is slidably fitted with the lower end of the lower end head 117. When the fluid separating device 010 moves to the bottom of the well, the start shaft 510 strikes the lower percussion device 203, and the start shaft 510 moves in the direction from the contracted position to the expanded position. During this process, the start shaft 510 pushes the second locking arm 141*b* to move radially outward, the whole locking piece 141 moves radially outward, and the first locking arm 141*a* is separated from the second locking structure 210. At this time, the limit effect on the mandrel 200 is released. During the movement of the start shaft 510 in the direction from the contracted position to the expanded position, the start shaft 510 can also strike the lower end shaft 250 of the mandrel 200, which can assist the mandrel 200 to move to the expanded position. The end surface of the start shaft 510 which is near the lower end shaft 250 is spherical, in this way, when the start shaft 510 contacts the second locking arm 141*b*, the second locking arm 141*b* can be smoothly pushed radially outward. Because the first locking arm 141*a* is separated from the second locking structure 210 driven by the contact of the start shaft 510 and the second locking arm 141*b*, the fitting surface (which is near the start shaft 510) between the second locking structure 210 and the first locking arm 141*a* can be a plane which is perpendicular to the mandrel 200, so that the radial position of the mandrel 200 is better limited and the mandrel 200 can be more reliably maintained in the contracted position.

Further, in this embodiment, the first locking structure 140 further includes a support shaft 143 fixed in the cylinder 110; the support shaft 143 is located between the first locking arm 141*a* and the second locking arm 141*b*. By providing the support shaft 143, the locking piece 141 can be guided, and the locking piece 141 can reliably move in a radial direction, so that the locking piece 141 can smoothly fit with or separate from the second locking structure 210.

In this embodiment, an annular space 111 is formed between a part of the inner peripheral surface of the cylinder 110 and a part of the outer peripheral surface of the mandrel 200, namely, the outer peripheral surface of the mandrel 200 is not in contact with an inner peripheral surface of the straight cylinder 115 to form the annular space 111. In this way, the friction between the mandrel 200 and the cylinder 110 can be reduced, so that the movement resistance of the mandrel 200 is reduced, further, the transition of the mandrel 200 between the contracted position and the expanded position can be smoother.

Further, in this embodiment, an outlet 112 and an inlet 113 communicating the annular space 111 with the outside environment are disposed on the cylinder 110; the separator 120 is located between the outlet 112 and the inlet 113; the outlet 112 is near the expanded position; the inlet 113 is near the contracted position; the fluid separating device 010 further includes a blocking unit 610 connected to the mandrel 200; when the mandrel 200 is located in the expanded position, the blocking unit 610 closes the outlet 112; when the blocking unit 610 is located in the contracted position, the blocking unit 610 is away from the outlet 112, so that the outlet 112 is open. When the blocking unit 610 is located in the contracted position, the inlet 113 is open, during the downward movement of the blocking unit 610, the oil or natural gas below the fluid separating device 010 can enter the annular space 111 through the inlet 113, and then flow out above the fluid separating device 010 through the outlet 112, in this way, the downward resistance to the fluid separating device 010 is further reduced and the downward speed of the fluid separating device 010 is increased. In this embodiment, the inlet 113 is disposed on the lower end head 117 and the outlet 112 is disposed on the upper end head 116.

Figure 10:
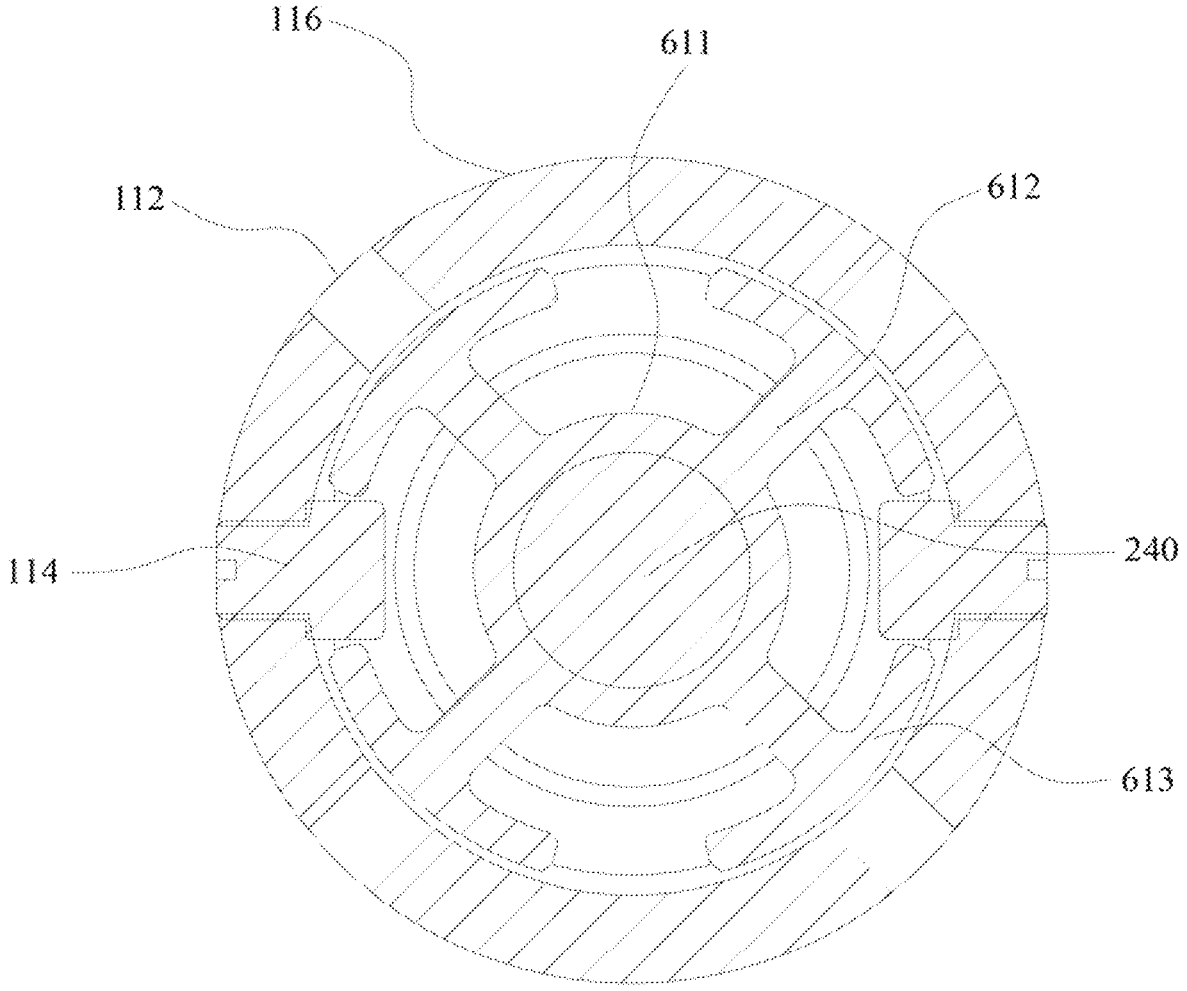
FIG. 10 is a cross-sectional view of a blocking unit in the fluid separating device according to the first embodiment of the present disclosure.

Further, refer to FIG. 10, the blocking unit 610 includes a connecting ring 611 sleeved on the upper end shaft 240 of the mandrel 200, a connecting section 612 extending radially outward from the connecting ring 611, and a blocking piece 613 connected to the end of the connecting section 612 which is away from the connecting ring 611.

Further, in this embodiment, a plurality of outlets 112 spaced out around the axis of the cylinder 110 are disposed on the cylinder 110; a plurality of connecting sections 612 are spaced out around the axis of the connecting ring 611; a plurality of connecting sections 612 correspond to a plurality of outlets 112 one by one; each connecting section 612 is respectively connected to a blocking piece 613; a guiding piece 114 is disposed between the adjacent blocking pieces 613 in the cylinder 110, and slidably contacts the adjacent blocking pieces 613. By providing the guiding piece 114, the blocking unit 610 is avoided from rotating with the mandrel 200, further, the situation that the outlet 112 cannot be closed is avoided and the working reliability of the fluid separating device 010 is improved.

In summary, the fluid separating device provided in the embodiment of the present invention, when the fluid separating device ascends to the upper end of the wellhole, the mandrel strikes the upper percussion device, so that the mandrel moves from the expanded position to the contracted position. When the mandrel is located in the contracted position, the separator is not in contact with the inner wall of the wellhole and forms an annular gap to allow fluid to pass through. In this way, the friction between the separators and the inner wall of the wellhole is eliminated, and the oil or natural gas below the fluid separating device can flow upward through the annular gap, reduces the downward resistance to the fluid separating device, so that the fluid separating device can further quickly descend back to the bottom of the well. Even when the well is not shut down, the fluid separating device can quickly descend back to the bottom of the well. At the same time, during the downward movement of the fluid separating device, the service life of the separator is greatly improved due to the elimination of the friction between the separator and the inner wall of the wellhole. In addition, because the fluid separating device ascends under the thrust of the oil or natural gas below, its upward speed is fast, and the impact force between the mandrel and the upper percussion device is large, as the mandrel moves toward the contracted position, the elastic energy storage device and the first elastic piece are compressed, so that the kinetic energy generated by the impact is stored in the elastic energy storage device. The fluid separating device descends under the action of its own gravity, its downward speed is slower than the upward speed, and the impact force between the mandrel and the lower percussion device is small. Because energy is stored in the elastic energy storage device, it is only required that the first locking device and the second locking device can be separated from each other when the mandrel strikes the lower percussion device, the elastic energy storage device can drive the mandrel to move to the expanded position. In this way, the requirement for the impact force of the mandrel and the lower percussion device is reduced, and only a small impact force between the mandrel and the lower percussion device is needed to complete the transition of the mandrel from the contracted position to the expanded position, which improves the reliability of the fluid separating device and the wellhole structure at work.

The above description is only a part of the embodiments of the present invention and is not intended to limit the present invention, and for the technicians in this field, the present invention may have various modifications and changes. Any modification, equivalent replacement, improvement, etc. made within the spirit and principle of the present invention should be included in the protection scope of the present invention.

What is claimed is:

1. A fluid separating device, comprising:

a cylinder;

a plurality of separators disposed around the cylinder;

a first elastic piece, disposed between one of the separators and the cylinder, and applying a first elastic force to the separator outward in a radial direction of the cylinder;

a mandrel, passing through the cylinder axially and configured to reciprocate between an expanded position and a contracted position in an axial direction of the cylinder;

an elastic energy storage device, slidably passing through the cylinder along the radial direction of the cylinder, the elastic energy storage device having one end connected to the mandrel and another end connected to the separator, the elastic energy storage device being configured to apply a third elastic force to the mandrel in a direction from the contracted position to the expanded position;

a first locking structure disposed on the cylinder; and a second locking structure disposed on the mandrel;

wherein, when the mandrel moves toward the contracted position, the elastic energy storage device is compressed and drives the separator to move inward along the radial direction of the cylinder; and when the mandrel is in the contracted position, the first locking structure and the second locking structure are detachably fitted to each other to maintain the mandrel in the contracted position, wherein the elastic energy storage device comprises a guiding post and an energy storage spring; the guiding post can slidably penetrate the cylinder along the radial direction of the cylinder; one end of the guiding post is connected to the separator, another end of the guiding post is connected to one end of the energy storage spring; and another end of the energy storage spring is connected to the mandrel.

2. The fluid separating device of claim 1, wherein the energy storage spring is a curved spring, and the energy storage spring comprises a first force receiving arm, a second force receiving arm and a bending section; one end of the first force receiving arm is connected to the mandrel; one end of the second force receiving arm is connected to the guiding post; another end of the first force receiving arm is connected to another end of the second force receiving arm by the bending section.

3. The fluid separating device of claim 2, wherein the end of the first force receiving arm away from the bending section is connected to a rotation section; a rotation hole is disposed on the guiding post; and the rotation section is rotatably fitted with the rotation hole.

4. The fluid separating device of claim 2, wherein an accommodation hole is disposed on an outer peripheral surface of the mandrel; the end of the second force receiving arm away from the bending section is embedded in the accommodation hole.

5. The fluid separating device of claim 2, further comprising:

a fixing shaft fixed in the cylinder;

wherein the bending section is disposed around the fixing shaft.

6. The fluid separating device of claim 5, further comprising:

a fixing ring fixed on an inner peripheral surface of the cylinder; and a fixing groove disposed on the fixing ring;

wherein the fixing shaft is fixed in the fixing groove.

7. The fluid separating device of claim 1, wherein the first locking structure comprises a locking piece and a second elastic piece; the second locking structure is a locking groove disposed on the mandrel; the second elastic piece is located between the locking piece and an inner surface of the cylinder, and applies a second elastic force to the locking piece inward along the radial direction of the cylinder;

when the mandrel is in the contracted position, the locking piece is embedded in the second locking structure under an action of the second elastic piece.

8. The fluid separating device of claim 7, wherein the locking piece comprises a base, and a first locking arm and a second locking arm spaced apart from each other; both of the first locking arm and the second locking arm are connected to the base; the first locking arm is used to be embedded in the second locking structure;

the fluid separating device further comprises a start shaft; the start shaft is disposed slidably at one end of the cylinder close to the contracted position; when the start shaft moves in the direction from the contracted position to the expanded position, the start shaft pushes the second locking arm to move radially outward, so that the first locking arm is separated from the second locking structure.

9. The fluid separating device of claim 8, wherein the first locking structure further comprises a support shaft fixed in the cylinder; the support shaft is located between the first locking arm and the second locking arm.

10. The fluid separating device of claim 1, wherein an annular space is formed between a part of an inner peripheral surface of the cylinder and a part of an outer peripheral surface of the mandrel.

11. The fluid separating device of claim 10, wherein an outlet and an inlet communicating the annular space with an outside environment are disposed on the cylinder; the separator is located between the outlet and the inlet; the outlet is close to the expanded position; the inlet is close to the contracted position;

the fluid separating device further comprises a blocking unit connected to the mandrel; when the mandrel is located in the expanded position, the blocking unit closes the outlet; when the blocking unit is located in the contracted position, the blocking unit is away from the outlet, so that the outlet is open.

12. The fluid separating device of claim 11, wherein the blocking unit comprises a connecting ring sleeved on the mandrel, a connecting section extending radially outward from the connecting ring, and a plurality of blocking pieces each connected to an end of the connecting section away from the connecting ring.

13. The fluid separating device of claim 12, wherein a plurality of the outlets are disposed at intervals around an axis of the cylinder; a plurality of the connecting sections are disposed at intervals around an axis of the connecting ring; the connecting sections are disposed correspondingly to the outlets, each of the connecting sections is connected to one of the blocking pieces;

a guiding piece is disposed between the adjacent blocking pieces in the cylinder, and slidably contacts the adjacent blocking pieces.

* * * * *